US008434836B2

(12) United States Patent
Holcomb

(10) Patent No.: US 8,434,836 B2
(45) Date of Patent: May 7, 2013

(54) SLIDE ASSEMBLY

(75) Inventor: Gregory Jon Holcomb, Cedar Falls, IA (US)

(73) Assignee: Waterloo Industries, Inc., Oak Creek, WI (US)

( * ) Notice: Subject to any disclaimer, the term of this patent is extended or adjusted under 35 U.S.C. 154(b) by 607 days.

(21) Appl. No.: 12/201,382

(22) Filed: Aug. 29, 2008

(65) Prior Publication Data

US 2009/0058242 A1 Mar. 5, 2009

Related U.S. Application Data

(60) Provisional application No. 60/968,922, filed on Aug. 30, 2007.

(51) Int. Cl.
*A47B 88/04* (2006.01)

(52) U.S. Cl.
USPC ..... 312/334.1; 312/333; 312/334.44

(58) Field of Classification Search ..... 312/333, 312/334.1, 334.7, 334.44, 334.47, 334.46, 312/334.4, 334.8; 384/21
See application file for complete search history.

(56) References Cited

U.S. PATENT DOCUMENTS 2,064,926 A * 12/1936 Kuebler ..... 62/382
3,371,968 A * 3/1968 Loake ..... 384/18
3,985,224 A * 10/1976 Harvey ..... 198/851
4,272,139 A * 6/1981 Fler ..... 312/334.11
4,429,930 A * 2/1984 Blouin ..... 312/216
4,469,384 A * 9/1984 Fler et al. ..... 312/333
4,749,242 A * 6/1988 Rechberg ..... 312/333
4,768,844 A * 9/1988 Ludwig ..... 312/221
4,988,214 A * 1/1991 Clement ..... 384/18
5,199,774 A * 4/1993 Hedinger et al. ..... 312/219
5,255,983 A * 10/1993 Parvin ..... 384/21
5,364,179 A * 11/1994 Brustle et al. ..... 312/333
5,433,517 A * 7/1995 Fleisch ..... 312/334.8
5,551,775 A * 9/1996 Parvin ..... 312/334.11
5,702,167 A * 12/1997 Muller ..... 312/221
5,757,109 A * 5/1998 Parvin ..... 312/334.11
6,209,979 B1 * 4/2001 Fall et al. ..... 312/330.1
6,224,177 B1 5/2001 Chu
6,340,078 B1 * 1/2002 Scheible ..... 188/166
6,390,575 B1 * 5/2002 Chen et al. ..... 312/334.46
6,402,275 B1 * 6/2002 Yang ..... 312/334.46
6,412,891 B1 * 7/2002 Liang et al. ..... 312/334.44
6,497,464 B1 * 12/2002 Cammack et al. ..... 312/333
6,502,910 B2 * 1/2003 Kuo-Chan ..... 312/333
6,629,738 B2 * 10/2003 Salice ..... 312/333

(Continued)

*Primary Examiner* — James O Hansen
*Assistant Examiner* — Sasha T Varghese
(74) *Attorney, Agent, or Firm* — Calfee, Halter & Griswold LLP

(57) ABSTRACT

A slide assembly includes a catch assembly secured to a first rail member, and a second rail member in sliding engagement with the first rail member. The second rail member includes a post extending laterally towards the first rail member. The catch assembly includes a catch member pivotable between a post retaining position and a post releasing position. When the catch member is in the post releasing position, movement of the second rail member from an extended position to a retracted position causes the post to engage a bearing surface of the catch member to pivot the catch member from the post releasing position to the post retaining position. The bearing surface of the catch member is contoured to provide substantially continuous and uniform engagement between the bearing surface and the post as the post pivots the catch member from the post releasing position to the post retaining position.

11 Claims, 4 Drawing Sheets

U.S. PATENT DOCUMENTS 6,685,288 B1 * 2/2004 MacMillan ..... 312/334.46
6,962,397 B2 * 11/2005 Dobler et al. ..... 312/333
7,028,370 B2 * 4/2006 Hoshide et al. ..... 16/96 R
7,040,725 B1 * 5/2006 Mao-Chin ..... 312/334.44
7,083,243 B2 * 8/2006 Lee ..... 312/333
7,229,142 B2 * 6/2007 Lin ..... 312/333
7,244,005 B1 * 7/2007 Lu ..... 312/333
7,413,269 B2 * 8/2008 Chen et al. ..... 312/333
7,458,651 B1 * 12/2008 Radke et al. ..... 312/333
7,484,817 B2 * 2/2009 Hoffman et al. ..... 312/219
7,967,399 B1 * 6/2011 Baiza et al. ..... 312/223.1
2004/0212283 A1 * 10/2004 Gasser ..... 312/333
2007/0001562 A1 * 1/2007 Park ..... 312/333

* cited by examiner

SLIDE ASSEMBLY

CROSS-REFERENCE TO RELATED APPLICATION

This application claims the benefit of U.S. Provisional Patent Application Ser. No. 60/968,922, entitled "SLIDE ASSEMBLY" and filed Aug. 30, 2007, the entire contents of which is incorporated herein by reference, to the extent that it is not conflicting with the present application.

BACKGROUND OF THE DISCLOSURE

Telescoping track slide assemblies are commonly used, for example, in desks, cabinets or other furniture items, for providing a smooth and consistent mechanism for sliding operation (e.g., opening and closing) of a drawer or other such component. One conventional design for a slide assembly includes outer rails affixed to the structure of the furniture item, inner rails affixed to the sliding component (typically one on either side of the sliding component), and intermediate rails disposed between the outer rails and inner rails, which may provide additional support for the sliding component when the sliding component is in an extended position. Sliding bearings including, for example, ball bearings, may be disposed between the outer rails and intermediate rails, and between the intermediate rails and inner rails, to prevent binding between the rails and to provide for a smooth sliding motion.

SUMMARY

The present application describes slide assemblies having features directed to improved durability of the slide assembly, for example, to withstand wear associated with vibration and with repeated opening and closing.

Accordingly, in one embodiment, a slide assembly includes a catch assembly secured to a first rail member, and a second rail member in sliding engagement with the first rail member. The second rail member includes a post extending laterally towards the first rail member. The catch assembly includes a catch member pivotable between a post retaining position and a post releasing position. When the catch member is in the post releasing position, movement of the second rail member from an extended position to a retracted position causes the post to engage a bearing surface of the catch member to pivot the catch member from the post releasing position to the post retaining position. The bearing surface of the catch member is contoured to provide substantially continuous and uniform engagement between the bearing surface and the post as the post pivots the catch member from the post releasing position to the post retaining position.

BRIEF DESCRIPTION OF THE DRAWINGS

Features and advantages of the invention will become apparent from the following detailed description made with reference to the accompanying drawings, wherein.

DETAILED DESCRIPTION

In some applications, for example, when used with cabinets that may be exposed to jostling, vibration, and other movement, it may be desirable to provide a detent, catch, or other secure engagement of the telescoping slides when in a closed or retracted condition, to prevent inadvertent opening of the drawers or other sliding components during movement of the cabinet, as such opening may pose a safety risk or result in a loss of contents of the cabinet drawers.

Figure 1:
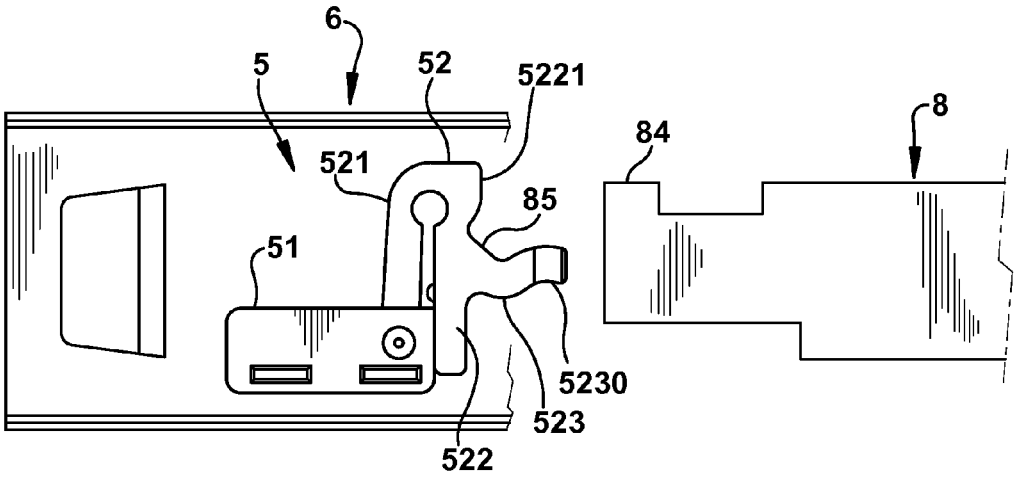
Fig.1 (Prior Art)
FIG. 1 illustrates a partial side view of a slide assembly in an extended condition.
Figure 2:
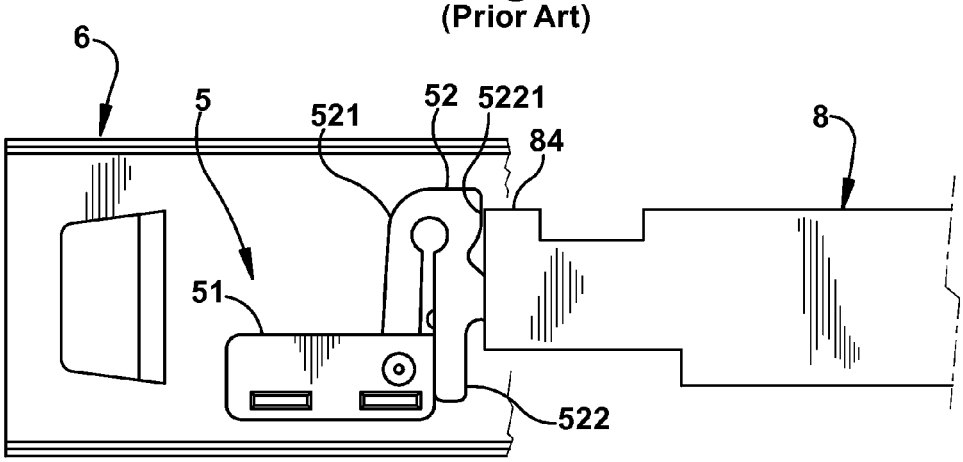
Fig.2 (Prior Art)
FIG. 2 illustrates a partial side view of the slide assembly of FIG. 1, with the inner rail in a movable block engaging position.
Figure 3:
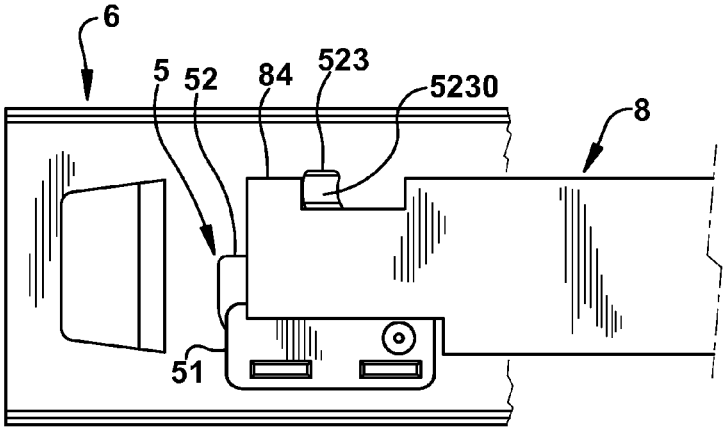
Fig.3 (Prior Art)
FIG. 3 illustrates a partial side view of the slide assembly of FIG. 1, shown in a retracted condition.
Figure 4:
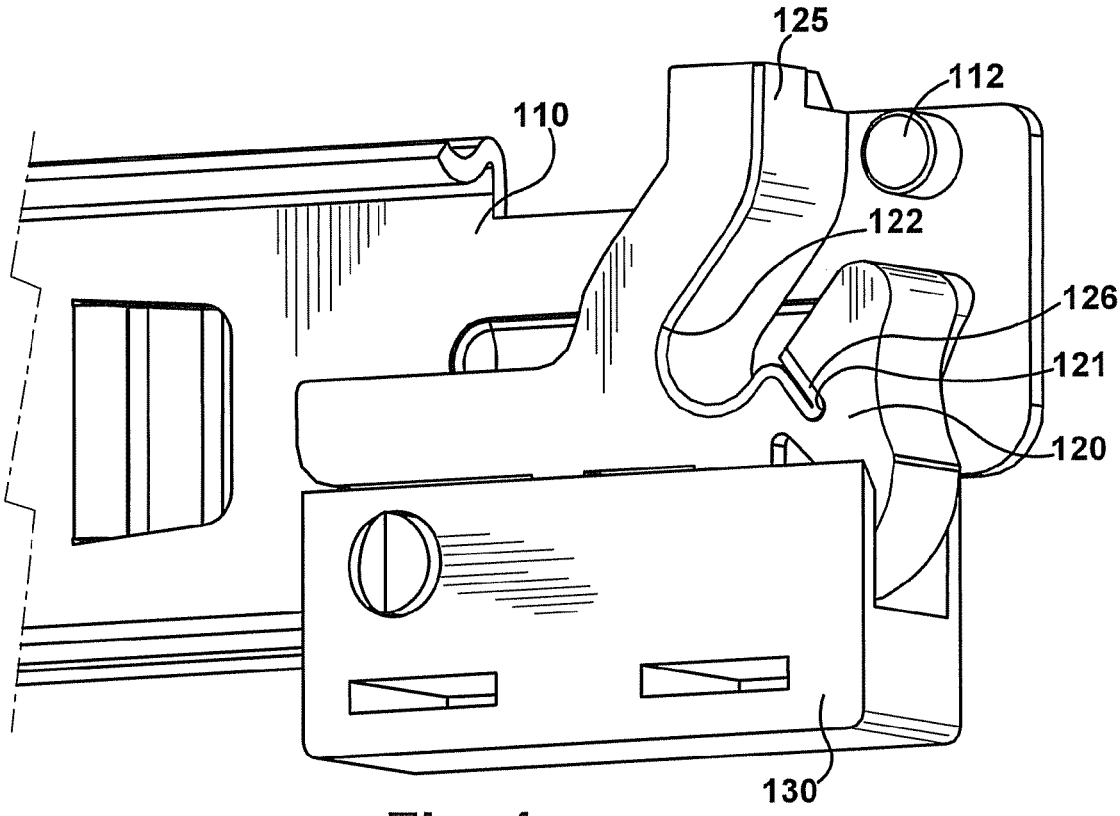
FIG. 4 illustrates a perspective view of a rail and catch member arrangement for a slide assembly.
Figure 5:
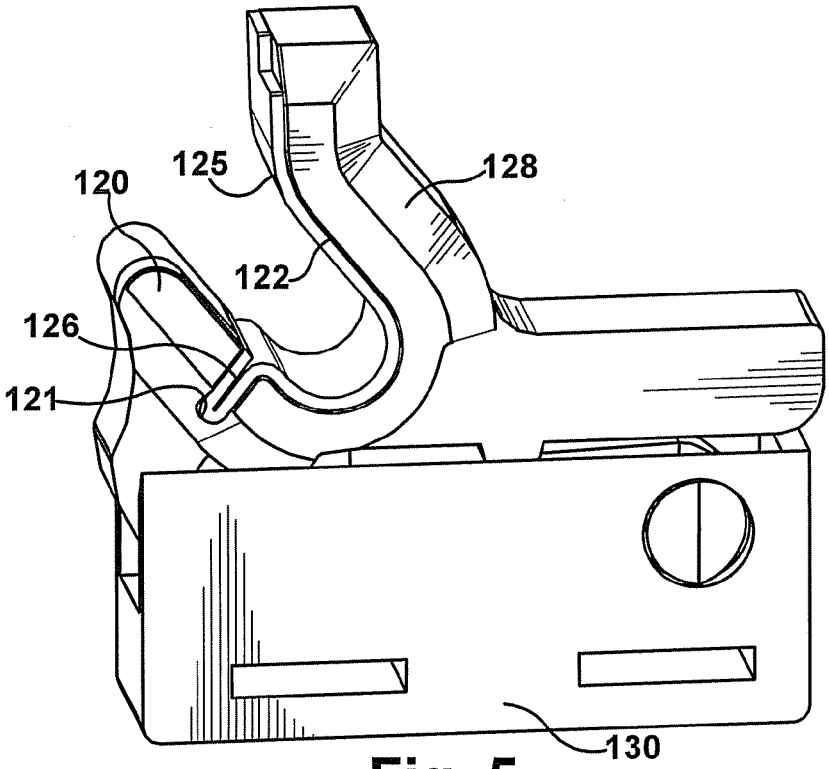
FIG. 5 illustrates an opposite side perspective view of the catch member and fixed block of FIG. 4.
Figure 6:
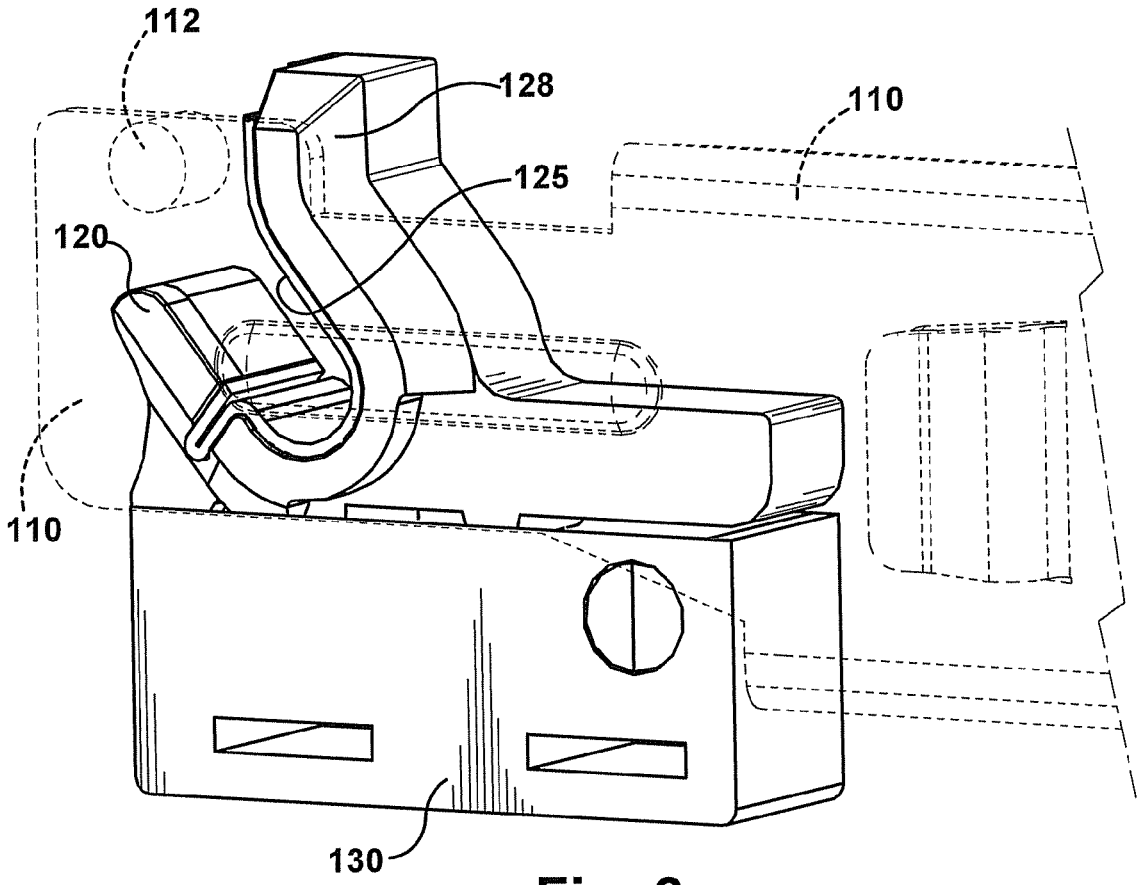
FIG. 6 illustrates an opposite side perspective view of the rail and catch member arrangement of FIG. 4, with the rail member shown in phantom to illustrate additional features of the arrangement.

Many different catch or slide positioning mechanisms may be utilized to secure the sliding mechanism against inadvertent outward sliding or extension. One such embodiment is described in U.S. Pat. No. 6,224,177 (the "'177 patent"), the entire disclosure of which is incorporated by reference herein, to the extent it is not conflicting with the present application. In the device of the '177 patent, as shown in FIGS. 1-3 (corresponding to FIGS. 6-8 of the '177 patent), a positioning mechanism 5 includes a fixed block 51 and a movable block or catch member 52 pivotally connected to the fixed block 51 for movement between a perpendicular (to the fixed block 51) or slide disengaged position and a parallel (to the fixed block 51) or slide engaged position. The movable block 52 includes flexible arms or clamping arms 521, 522 spaced to receive an end wall of the fixed block 51 between them when the movable block 52 is in the slide disengaged position. When a pivoting force is applied to the movable block 52, the arms 521, 522 spread to allow the movable block 52 to move with respect to the end wall of the fixed block 51. As the movable block nears the slide engaged or slide disengaged position, inward biasing forces from the flexed arms 521, 522 bias the movable block 52 into the corresponding slide engaged or disengaged position, and the arms 521, 522 snap back to the non-flexed condition. The arms 521, 522 of the illustrated embodiment are configured to be rigid enough to resist inadvertent movement of the movable block 52 between the slide engaged and slide disengaged positions (for example, from vibration, jostling, or other movement), yet flexible enough to allow pivoting of the movable block 52 when user applied force is imparted on the movable block 52 via the drawer (not shown) and inner rail 8.

When moving the sliding track assembly of the '177 patent into a closed or retracted position, the inner rail 8 is pushed or telescoped inward with respect to the outer rail 6. A locating flange 84 at the end of the inner rail 8 engages a front edge or upper part 5221 of the movable block 52 to impart a pivoting force on the movable block 52. As the movable block 52 is pivoted to the slide engaged position, the locating flange 84 is accommodated by a flat angular notch or guide groove 85 in the movable block 52. When the slide assembly is fully retracted, the locating flange 84 is retained in the retracted position by a locating flange 523 of the movable block 52. To extend the slide assembly and open the drawer, the inner rail 8 is pulled or telescoped outward with respect to the outer rail 6. The locating flange 84 imparts a pivoting force on the locating flange 523 of the movable block 52 to pivot the movable block 52 to the slide disengaged position, thereby releasing the locating flange 84 and allowing the inner rail 8 to slide outward to an extended position.

As shown in FIGS. 1-3, the movable block 52 of the illustrated slide assembly includes a sloping guide face 5230 on the locating flange 523. When the movable block 52 is inadvertently placed in the slide engaging position while the inner rail 8 is extended, the sloping guide face 5230 allows the inner rail locating flange 84 to slip past the movable block locating flange 523 for retention of the inner rail 8 in the retracted position.

While the slide assembly of the '177 patent prevents inadvertent opening of a cabinet drawer due to vibration, jostling, or other such movement, this type of movement may still contribute to wear or damage to the movable block 52, particularly to the locating flange 523, as the metal inner rail flange 84 repeatedly bumps against the plastic movable block 52. Over time, this damage may cause the locating flange 523 of the movable block 52 to fracture or fail, compromising secure retention of the inner rail 8 in the retracted position.

The present application contemplates a slide assembly configured such that engagement between a rail member and a catch member or movable block is adapted to minimize wear or impact-related damage resulting both from inadvertent movement of the rail member with respect to the catch member (for example, due to vibration, jostling, and other such movements) and from repeated opening and closing of the slide assembly.

According to one inventive aspect of the present application, a catch member and a catch engaging portion of a sliding rail member may be configured to more evenly distribute the impact forces resulting from movement of the catch engaging portion against the catch member. In one embodiment, a catch engaging portion of a rail member may be provided with a rounded or arcuate engaging surface contoured to reduce wear or abrasion of a contacting or bearing surface of the catch member. While the engaging surface may be integrally formed with the rail member (for example, by rounding or bending a leading edge of a locating flange 84 of an inner rail 8, as shown in the assembly of FIGS. 1-3), a contoured catch engaging portion may be affixed to the rail member, for example, by welding, fastening (with adhesives or mechanical fasteners), or a press fit engagement.

In the illustrated embodiment of FIGS. 4-7, a rail member 110 includes a catch engaging post 112 affixed to a catch facing side of the rail member 110. In one exemplary embodiment, the post 112 is pressed and spun into place. While the post 112 may be provided in many different shapes, the cylindrical shaped post 112 of the illustrated embodiment provides a rounded or arcuate engaging surface contoured to distribute impact forces between the post 112 and a catch member 120 to reduce wear or abrasion of the catch member 120. While the post 112 may be constructed of many different materials or by many different methods, in one embodiment, a hardened cold rolled steel pin may be used to form the post 112.

According to another inventive aspect of the present application, a catch member may be provided with a guide groove or bearing surface contoured to allow a catch engaging portion to impart substantially continuous, uniform engagement with the catch member through a range of pivoting motion of the catch member between slide engaged (or post retaining) and slide disengaged (or post releasing) positions, for example, to provide for smooth movement and reduced wear when moving the rail member into or out of the fully retracted position. In the illustrated embodiment, the catch member 120 includes a J-shaped or ladle-shaped guide groove or bearing surface 122 contoured or otherwise shaped to provide substantially continuous, uniform engagement between the post 112 and the catch member 120 as the catch member is pivoted (with respect to fixed block or catch retainer 130) between post retaining and post releasing positions. During pivoting of the catch member 120, the post 112 rides along the bearing surface 122, thereby minimizing uneven, rough, or jerky operation of the slide into or out of the fully retracted position, as well as reducing point-to-point impact between the post 112 and catch member 120 during pivoting.

According to another inventive aspect of the present application, a bearing surface of a catch member may be provided in a more durable material, to better withstand repeated impacts between the catch member and an engaging portion of a rail member. While a catch member may be provided in a more durable or wear resistant material, such as steel, in another embodiment, a catch member may be provided with a wear resistant bearing member (made of steel or some other wear resistant material) affixed to the catch member on at least a portion of the bearing surface of the catch member. This may, for example, allow for a more flexible material for portions of the catch member that flex during pivoting, while retaining a more wear resistant bearing surface to better withstand impact from an engaging portion of the rail member. Many different materials and manufacturing methods may be used to construct the bearing surface, including, for example, die-formed spring steel material.

In the illustrated embodiment, a bearing plate 125 is affixed to a rail contacting (or post engaging) portion of the catch member 120 to provide a wear resistant bearing surface. While many different configurations may be used to affix the bearing plate 125 to the catch member 120, including, for example, use of an adhesive or fastener, in the illustrated embodiment, the bearing plate 125 is pressed into the catch member 120 and snapped into place. As shown, portions of the bearing plate 125 may be bent or folded to assist in securing the plate 125 to the catch member 120. For example, one end 126 of the bearing plate 125 may be folded and press fit into a corresponding recess 121 in the catch member 120. As shown, the bearing plate 125 may, but need not, provide a contoured bearing surface for continuous, uniform engagement between the catch member 120 and engaging portion 112 during pivoting of the catch member 120, as described in greater detail above.

As with the movable block 52 of the embodiment of FIGS. 1-3, the exemplary catch member 120 of the present application may also be provided with a sloped or chamfered front edge 128, opposite the bearing surface. When the illustrated catch member 120 is inadvertently placed in the post retaining position while the rail member 110 is extended, the chamfered front edge 128 allows the post 112 to slip past the catch member 120 for retention of the rail member 110 in the retracted position. While the chamfered portion 5230 of the movable block 52 of the embodiment of FIGS. 1-3 is provided as a narrow groove, in the embodiment of FIGS. 4-7, the chamfered edge 128 extends along a greater portion of the catch member 120 to ensure full engagement of the wider post 112 with the chamfered edge 128.

Figure 7:
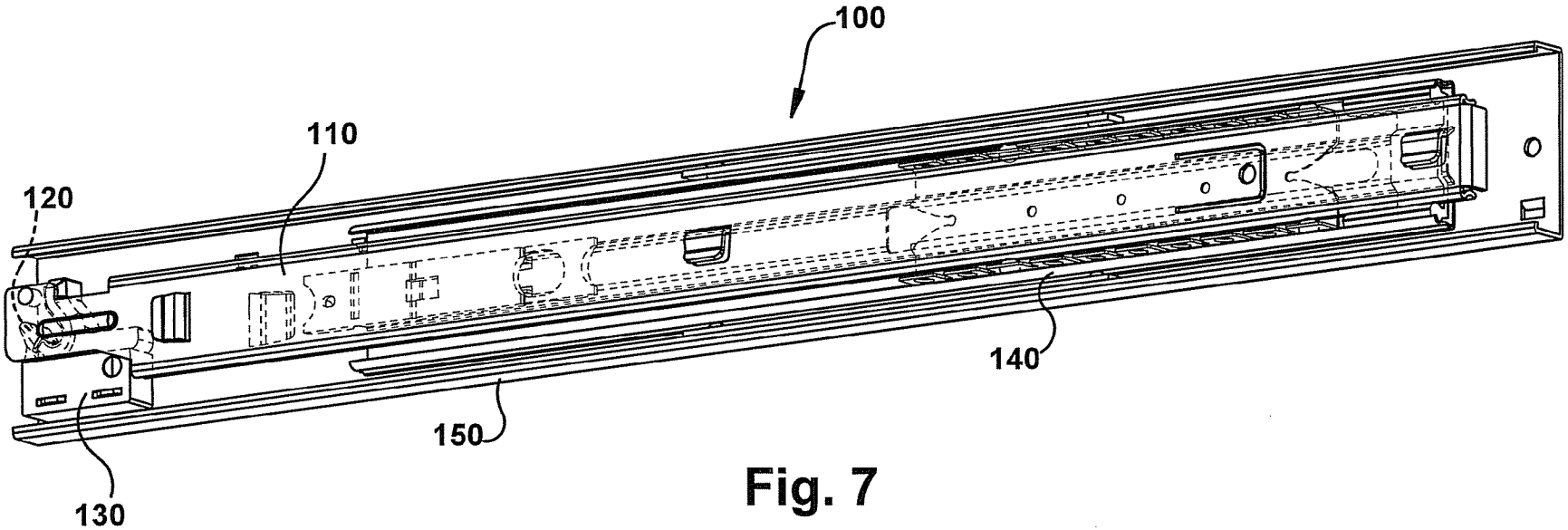
FIG. 7 illustrates a slide assembly, with the rail member shown in phantom to illustrate additional features of the arrangement.

FIG. 7 illustrates an exemplary slide assembly 100 incorporating inventive features of the present application. It should be noted that other aspects and components of the slide assembly 100 may, but need not, be consistent with the slide assembly of the '177 patent. For example, while the illustrated slide assembly 100 includes a catch member 120 assembled with an outer rail member 150 for selective engagement with an inner rail member 110, in another embodiment (not shown), a catch member may be assembled with an outer rail member for selective engagement with an inner rail member. As another example, while the illustrated slide assembly 100 includes an intermediate rail member 140 disposed between an inner rail member 110 and an outer rail member 150 for sliding engagement of the inner rail member 110 with the outer rail member 150, in another embodiment (not shown), a slide assembly may be provided without an intermediate rail member, with an inner rail member (affixed to a drawer or other sliding component) in direct sliding engagement with an outer rail member (affixed to a cabinet or other structure).

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A slide assembly comprising:

a first rail member;

a second rail member in sliding engagement with said first rail member and axially slidable between a retracted position and an extended position, the second rail member including a post extending laterally towards the first rail member; and a catch assembly secured to the first rail member, the catch assembly including a catch member pivotable about a pivot point at a proximal end of the catch member between a post retaining position and a post releasing position;

wherein when the catch member is in the post releasing position, movement of the second rail member from the extended position to the retracted position causes an outer arcuate surface of the post to engage an inner arcuate bearing surface of the catch member to pivot the catch member from the post releasing position to the post retaining position;

further wherein the post rides along the inner arcuate bearing surface as the catch member is pivoted from the post releasing position to the post retaining position, and the inner arcuate bearing surface of the catch member is contoured to provide substantially continuous and uniform engagement between the bearing surface and the post as the post pivots the catch member from the post releasing position to the post retaining position;

wherein the catch member comprises a flexible body configured to bias the catch member from a partially pivoted position toward at least one of the post retaining position and the post releasing position; and further wherein the flexible body comprises a plastic material, and further wherein the bearing surface is disposed on a bearing member affixed to the flexible body, the bearing member comprising a metal plate of higher wear resistance relative to the flexible body, wherein the metal plate comprises a folded end press fit into a corresponding recess in the flexible body.

2. The slide assembly of claim 1, wherein the post is cylindrical.

3. The slide assembly of claim 1, wherein the inner arcuate bearing surface of the catch member is ladle-shaped.

4. The slide assembly of claim 1, wherein the inner arcuate bearing surface of the catch member is J-shaped.

5. The slide assembly of claim 1, wherein the catch member further comprises a chamfered edge spaced from and opposite the bearing surface, wherein when the catch member is in the post retaining position, movement of the second rail member from the extended position to the retracted position causes the arcuate surface of the post to engage the chamfered edge of the catch member, allowing the post to move axially past the bearing surface to retain the second rail member in the retracted position.

6. The slide assembly of claim 1, further comprising a third rail member laterally disposed between the first and second rail members, the third rail member being in sliding engagement with each of the first and second rail members.

7. The slide assembly of claim 1, wherein the catch assembly further comprises a catch retainer secured to the first rail member, the catch member being pivotably mounted to the catch retainer and seated in a channel in the catch retainer.

8. A slide assembly comprising:

a first rail member;

a second rail member in sliding engagement with said first rail member and axially slidable between a retracted position and an extended position, the second rail member including a cylindrical post extending laterally towards the first rail member; and a catch assembly including a catch retainer secured to the first rail member and a catch member pivotably mounted to the catch retainer and seated in a channel in the catch retainer, the catch member being pivotable about a pivot point at a proximal end of the catch member, between a post retaining position and a post releasing position;

wherein when the catch member is in the post releasing position, movement of the second rail member from the extended position to the retracted position causes the post to engage an inner arcuate bearing surface of the catch member to pivot the catch member from the post releasing position to the post retaining position, the inner arcuate bearing surface of the catch member being contoured to provide substantially continuous and uniform engagement between the bearing surface and the post as the post pivots the catch member from the post releasing position to the post retaining position;

further wherein the post rides along the inner arcuate bearing surface as the catch member is pivoted from the post releasing position to the post retaining position;

wherein the catch member comprises a flexible body configured to bias the catch member from a partially pivoted position toward at least one of the post retaining position and the post releasing position; and further wherein the flexible body comprises a plastic material, and further wherein the bearing surface is disposed on a bearing member affixed to the flexible body, the bearing member comprising a metal plate of higher wear resistance relative to the flexible body, wherein the metal plate comprises a folded end press fit into a corresponding recess in the flexible body.

9. The slide assembly of claim 8, wherein the inner arcuate bearing surface of the catch member is ladle-shaped.

10. The slide assembly of claim 8, wherein the catch member further comprises a chamfered edge spaced from and opposite the bearing surface, wherein when the catch member is in the post retaining position, movement of the second rail member from the extended position to the retracted position causes the post to engage the chamfered edge of the catch member, allowing the post to move axially past the bearing surface to retain the second rail member in the retracted position.

11. A slide assembly comprising:

a first rail member;

a second rail member in sliding engagement with said first rail member and axially slidable between a retracted position and an extended position, the second rail member including a post extending laterally towards the first rail member; and a catch assembly including a catch retainer secured to the first rail member, and a catch member pivotably mounted to the catch retainer and seated in a channel in the catch retainer, the catch member being pivotable about a pivot point at a proximal end of the catch member between a post retaining position and a post releasing position;

wherein the catch member includes a flexible body configured to bias the catch member from a partially pivoted position toward at least one of the post retaining position and the post releasing position, and a bearing plate affixed to the flexible body, the bearing plate comprising a material of increased wear resistance relative to the flexible body, wherein an endmost portion of the bearing plate is folded and press fit into a corresponding recess in the flexible body;

further wherein when the catch member is in the post releasing position, movement of the second rail member from the extended position to the retracted position causes the post to engage an inner arcuate bearing surface of the bearing plate to pivot the catch member from the post releasing position to the post retaining position; and further wherein the post rides along the inner arcuate bearing surface as the catch member is pivoted from the post releasing position to the post retaining position.

* * * * *